US005137621A

United States Patent [19]

Brown

[11] Patent Number: 5,137,621

[45] Date of Patent: Aug. 11, 1992

[54] INTEGRATED SCREENING SYSTEM FOR SIZING WOOD CHIPS

[75] Inventor: Robert A. Brown, Wenatchee, Wash.

[73] Assignee: Weyerhaeuser Company, Tacoma, Wash.

[21] Appl. No.: 487,535

[22] Filed: Mar. 2, 1990

[51] Int. Cl.[5] ..... B07B 9/00

[52] U.S. Cl. ..... 209/234; 209/441; 209/314; 209/315; 209/398; 241/81

[58] Field of Search ..... 209/233, 234, 311, 314, 209/315, 398, 402, 313, 629, 632, 634, 672, 680, 44.1, 254; 241/68, 81, 69

[56] References Cited

U.S. PATENT DOCUMENTS

| | | | |
|---|---|---|---|
| 235,739 | 12/1880 | Bushaw . | |
| 252,803 | 1/1882 | Salisbury . | |
| 450,482 | 4/1891 | Cox . | |
| 491,353 | 2/1893 | Higginson . | |
| 698,221 | 4/1902 | Piacentino . | |
| 873,326 | 12/1907 | Pearse . | |
| 927,086 | 7/1909 | Ulery . | |
| 1,099,420 | 6/1914 | Bryan . | |
| 1,252,273 | 1/1918 | Lever . | |
| 1,895,341 | 1/1933 | Parsonage | 209/398 X |
| 2,315,651 | 4/1943 | Peterson | 209/398 |
| 2,660,835 | 12/1953 | Burden | 209/234 X |
| 2,704,605 | 3/1955 | Dahlman | 209/234 |
| 2,829,772 | 4/1958 | Landes et al. | 209/323 |
| 3,337,139 | 8/1967 | Lloyd et al. | 241/20 |
| 4,234,416 | 11/1980 | Lower et al. | 209/247 |
| 4,376,042 | 3/1983 | Brown | 209/38 |
| 4,376,044 | 3/1983 | Ditzenberger | 209/234 |
| 4,430,210 | 2/1984 | Tuuha | 209/254 X |
| 4,504,386 | 3/1985 | Dyren et al. | 209/254 |
| 4,658,965 | 4/1987 | Smith | 209/672 |
| 4,802,591 | 2/1989 | Lower et al. | 209/680 |
| 4,865,720 | 9/1989 | Gilmore | 209/629 |
| 5,000,390 | 3/1991 | Marrs | 209/234 X |

FOREIGN PATENT DOCUMENTS

| | | | |
|---|---|---|---|
| 624046 | 9/1932 | Fed. Rep. of Germany . | |
| 748383 | 7/1933 | France . | |
| 66687 | 7/1927 | Sweden | 209/314 |
| 311669 | 9/1967 | U.S.S.R. . | |
| 845875 | 7/1981 | U.S.S.R. | 209/315 |
| 1491714 | 7/1989 | U.S.S.R. | 209/315 |
| 1203 | of 1901 | United Kingdom | 209/315 |
| 3326 | of 1912 | United Kingdom . | |
| 814542 | 6/1959 | United Kingdom . | |

OTHER PUBLICATIONS

E. Christensen, TAPPI Journal, vol. 59, No. 5 (May, 1976).

J. V. Hatton, "Chip Quality Evaluation", *Pulp and Paper Canada* vol. 77 No. 6, pp. 61-68, Jun., 1976.

J. V. Hatton, "Screening of Pulpwood Chips for Quality and Profit," *Paper Trade Journal*, Apr. 30, 1979.

*Primary Examiner*—Donald T. Hajec

*Attorney, Agent, or Firm*—Jensen & Puntigam

[57] ABSTRACT

A wood chip screen system which includes a gyratory screen apparatus (10) and a disk screen (12). The gyratory system apparatus includes a top screen element (14) and a lower screen (16). The inflow end of the disk screen (12) is immediately adjacent the outflow end of the top screen element (14), while the lower screen element (16) underlies the disk screen (12) for a substantial distance. The size of the openings in the top screen element (14) may be changed by the operator to optimize the operation of the system. The openings in top screen element (14) may also vary along its length. The system produces chips within the acceptable size range, chips which are below the acceptable size range (pin chips and fines), and over-thick chips, which are subsequently typically transmitted to a chip size reduction apparatus such as a slicer.

18 Claims, 3 Drawing Sheets

FIG. 4

LOADING B.O.T./HR./FT.$^2$

% PERFORMANCE FOR OVERTHICK REMOVAL

| HOLE SIZE | 0.2 | 0.3 | 0.4 | 0.5 | 0.6 | 0.7 | 0.8 | 0.9 | 1.0 | 1.1 | 1.2 | 1.3 |
|---|---|---|---|---|---|---|---|---|---|---|---|---|
| 1.38" | 77 | 79 | 82 | 84 | 85 | 87 | 89 | 90 | 93 | 95 | 96 | 98 |
| 1.25" | 82 | 84 | 87 | 88 | 89 | 90 | 92 | 94 | 95 | 97 | 99 | 100 |
| 1.13" | 87 | 89 | 90 | 91 | 93 | 95 | 98 | 99 | 99 | 100 | | |
| 1.00" | 90 | 92 | 94 | 95 | 97 | 99 | 99 | 100 | | | | |
| 0.87" | 97 | 97 | 98 | 99 | 99 | 100 | | | | | | |
| 0.75" | 99 | 99 | 99 | 99 | 100 | | | | | | | |

INTEGRATED SCREENING SYSTEM FOR SIZING WOOD CHIPS

TECHNICAL FIELD

The invention relates generally to the art of sizing wood chips, and more specifically concerns a chip sizing apparatus comprising an integrated combination of a gyratory screen and a thickness screen such as a disk screen.

BACKGROUND ART

It is well-known that the quality and size uniformity of the wood chip input are important factors in the paper-pulping process. Further, it has been established that the thickness dimension of the wood chips is a key parameter in achieving the desired chip size uniformity. Although the optimum chip thickness in a particular situation will depend upon the particular wood fiber used and the particular type of pulping process employed, the generally desired range of chip thickness is between 6 and 10 millimeters.

Throughout the history of the manufacture of paper pulp, high operational efficiency and quality of the resulting pulp product have been industry goals. The equipment involved in the pulping process, such as the chip screening apparatus for the chip inflow, is typically characterized by high mechanical tolerance and precision, which must be maintained during the operating life of the equipment in order to achieve the desired results on a sustained basis. Accordingly, such equipment is typically very expensive and time-consuming to alter in any significant way after installation, even though it may be desirable to change the particular thickness dimension of a portion of, or all of, the chip screen apparatus in order to optimize results in a particular situation. This is a disadvantage of existing systems.

Another significant factor involving the quality and efficiency of the pulping process concerns the undersized chips, which includes both pin chips and "fines". It is an important goal that as few undersize chips in the chip inflow as possible be provided to the pulp digester. Further, it is important that as few new undersize chips as possible be created during the separation of the chip inflow into the different fractions. For instance, additional undersize chips are typically created when the over-thick chips are routed to the slicer, which reduces the size of the chips. Those undersize chips will ordinarily proceed to the digester.

With respect to the prior art, early examples of chip-screening systems are discussed in an article by E. Christensen in the May, 1976 *TAPPI Journal,* Volume 59, No. 5. One system disclosed in that article concerns chip thickness separation by means of a disk screen, wherein the rejected over-thick chips are removed from the chip inflow first and then directed toward a size-reduction apparatus such as a slicer. The remaining material, which includes both chips within the acceptable range (accepts) as well as undersize chips, is then generally sent to a second screening station, such as a gyratory screen, for fines removal. This is in fact one of the most commonly used systems in the pulping industry today.

An advance over that system is described in U.S. Pat. No. 4,376,042 to Brown. That patent discloses the use of a conventional gyratory screen with a modified top deck (screen), the function of which is to divide the inflow of chips into a first fraction of acceptable chips and a second fraction which includes both over-size and over-thick chips as well as some acceptable chips. The second fraction is then directed to a disk (thickness) screen which separates the acceptable chips from the over-thick chips, which are then sent to a conventional size-reduction apparatus. This particular arrangement of the two basic types of chip-screening devices (an initial sizing screen, such as a conventional gyratory screen, followed by a thickness screen, such as a disk screen) has proven to be significantly more effective and efficient than either the gyratory screen or the disk screen alone, and also more effective than a combination of gyratory screen and disk screen, with the disk screen being positioned first.

Although there previously has been investigation as to the optimum relative configuration and arrangement between a conventional gyratory screen and a conventional disk screen, there has been little, if any, investigation as to the optimum configuration and arrangement of the individual screening elements of a gyratory screen, including the relationship of such individual screening elements to a disk screen.

DISCLOSURE OF THE INVENTION

Accordingly, the present invention is an apparatus for sizing an inflow of wood chips, including a first screening station which produces at least two fractions of wood chips, including a first fraction which includes substantially all the oversize chips and chips within an acceptable size range and a second fraction which includes substantially all the remaining chips within an acceptable size range. The invention also includes a second screening station, which produces at least two additional fractions of wood chips from the first fraction, including a third fraction which includes chips within the acceptable size range and a fourth fraction which includes chips which are oversize. In a first feature of the invention, the second screening station is integrated with the first screening station to the extent that an outflow end of a first portion of the first screening station is immediately adjacent to and is functionally integrated with the beginning of the second screening station. A second portion of the first screening station extends underneath the second screening station.

In another feature of the invention, the apparatus includes means for selectively changing the size of the openings in at least a portion of the top screen element of the first screening station.

In still another feature of the invention, the size of the openings in the top screen element of the first screening station are different in at least one portion of the top screen element relative to the remainder thereof.

BRIEF DESCRIPTION OF THE DRAWINGS

FIG. 4 is a table showing overthick chip removal for particular hole sizes and chip loading rates for the top screen element of a gyratory screen.

BEST MODE FOR CARRYING OUT THE INVENTION

Figure 1:
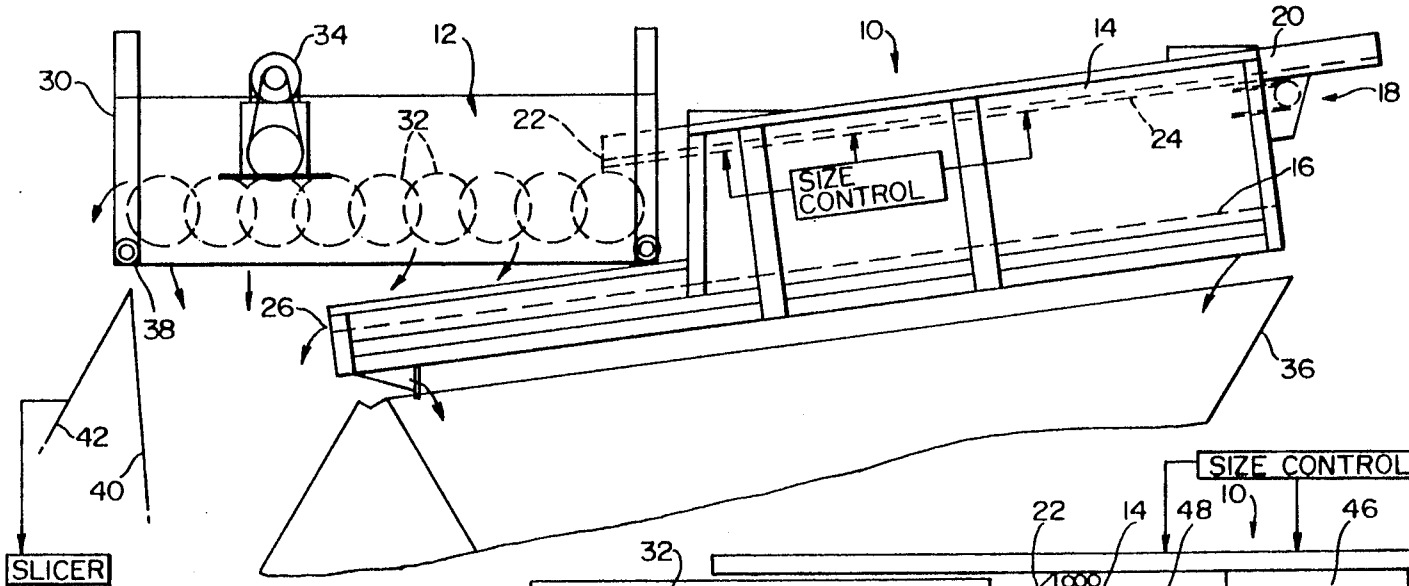
FIG. 1 is a side elevational view of the integrated chip-sizing screen combination of the present invention.
Figure 2:
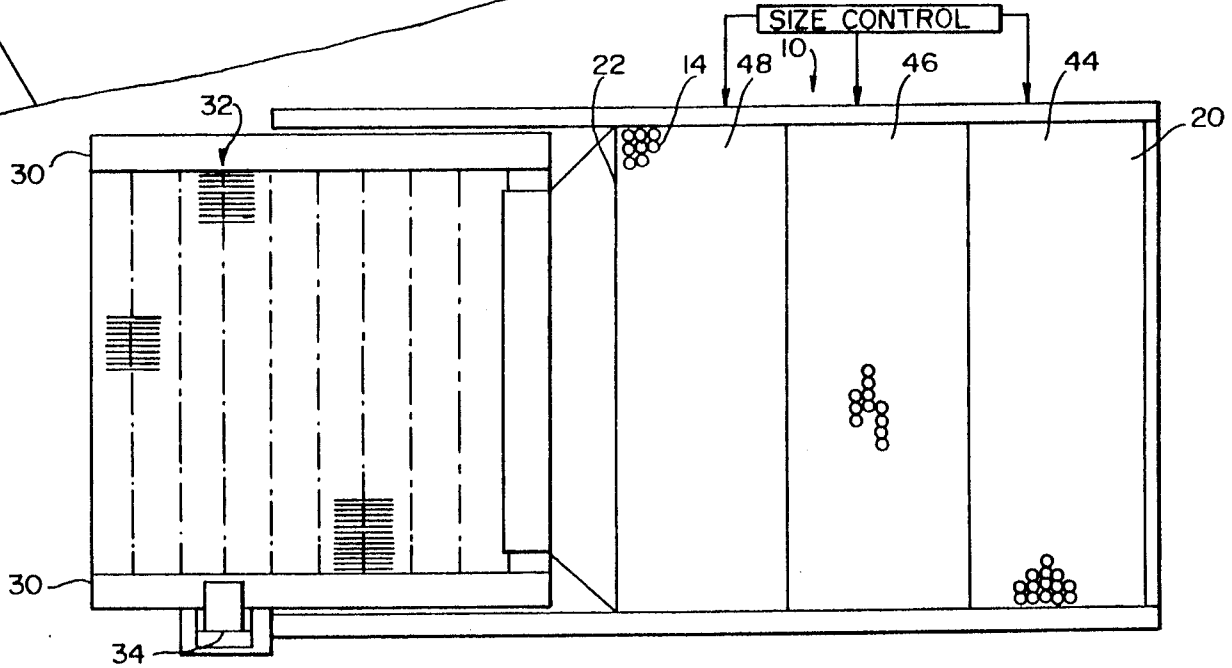
FIG. 2 is a top view of the apparatus of FIG. 1.

Referring to FIGS. 1 and 2, the present invention is a particular screen system for sizing wood chips which in turn are intended for use in a paper-pulping process. The apparatus includes a gyratory screen apparatus 10 which accomplishes an initial separation of an inflow of chips into several different fractions, and a thickness screen 12, such as a disk screen or a spiral roll screen, which is positioned directly adjacent the downstream end of the gyratory screen 10 and is structurally and functionally integrated with the gyratory screen in a manner described below.

The gyratory screen apparatus 10 includes a top screen element 14, a lower screen element 16, and a support structure shown generally at 18. The screen apparatus 10 includes a conventional drive system which is not shown specifically in FIG. 1 to produce the conventional vibrating action for the apparatus. The top screen element 14 will typically comprise either a punched plate or a woven wire screen having openings of a selected dimension. The lower screen element 16, also referred to as a fines screen, is in the embodiment shown positioned approximately 10–45 inches beneath the top screen element 14. The fines screen 16 typically comprises a punched plate or a woven wire screen having selected size openings which permit the fines chips in the chip inflow to pass therethrough.

A significant feature of the present invention is that the top screen element 14 is significantly shorter than the lower screen element 16, so that the outflow end 26 of screen element 16 extends a substantial distance beyond the outflow end 22 of the top screen element 14. This distance could be as little as 15% of the length of top screen 14 or as much as 100% thereof or even greater. In the particular embodiment shown the lower screen element 16 is a conventional 20 feet, while the top screen element 14 is only 12 feet long, i.e. in the embodiment shown, the lower screen element 16 is 67% longer than the top screen element 14.

Such an arrangement permits the structural and functional integration of the thickness screen 12 and the gyratory screen 10 into a unitary, high performance screening system. Positioned at the outflow end 22 of the top screen element 14 is the conventional thickness screen 12, which comprises a support structure shown generally at 30 and a plurality of disk screen members 32–32, each of which comprise a laterally extending support element on which there is closely mounted a plurality of thin disk elements. The individual disk elements of each disk member are interleaved with the disk elements of adjacent disk members. A motor 34 provides the driving power for the disk members, which rotate at a high speed in actual operation.

The disk screen 12 is not described in further detail because it is conventional in configuration and operation. The important feature is the relationship between the thickness screen 12 and the individual screening elements of gyratory screen 10. The inflow or upstream end of thickness screen 12 is immediately adjacent the outflow or downstream end of the top screen 14, such that a substantial portion of the lower screen 16 extends beneath the thickness screen, which results in additional undersize chip removal and hence an increase in undersize chip removal efficiency.

Positioned below the lower screen 16 is a conventional undersize chip chute 36 which extends to an undersize chip conveyor element (not shown), which in turn transports the undersize chips to a desired location. Positioned from the downstream end 26 of the lower screen 16 to the downstream end 38 of disk screen 12 and therebeneath is an accepts chute 40 which directs chips of acceptable size into accepts conveyor 41 which moves the chips into the digester for pulping. Extending a small distance beyond the downstream end 38 of disk screen 12 is an over-thick chute 42 which directs over-thick chips to an over-thick conveyor (not shown) which will direct them in turn typically to a size reduction apparatus, such as a slicer. The chips from the size reduction apparatus will be directed to the accepts conveyor directly or to the gyratory screen or the disk screen for reprocessing.

Another feature of the present invention is that the size of the openings in the top screen element 14 may vary along the length thereof. In the embodiment shown, the top screen element 14 is divided longitudinally into three sections, with each section having different size openings. Typically, the openings will decrease in size from the inflow end 20 to the outflow end 22. This arrangement permits optimization of the mass flow rate of chips rejected by the top screen 14, taking advantage of the relationship which exists between chip length, chip width, screen hole size and a specific chip loading rate (in bone dry tons per hour per square foot of screen surface). However, it should be understood that the size of the openings could change in a more regular fashion, or in fact could change in a particular pattern, including decreasing in size or initially decreasing and then increasing or vice-versa along the length of the top screen element 14.

In addition, the invention contemplates structure for conveniently changing the size of the openings after the installation of the system, even during actual operation of the screen apparatus 10. Such structure would in fact permit the operator of the equipment to change the size of the openings, in order to optimize the operation of the system relative to a particular type of inflow or particular pulping equipment. Although the use of variable size openings over the entire screen (the same size of opening for the entire screen) for sizing equipment is perhaps known in other industries, for instance, the almond industry, the use of such a system in the wood chip industry is unknown and has been previously thought to be unworkable for sizing chips. The capability of changing the size of the openings can be accomplished in a number of different ways. One embodiment includes a second top screen element, i.e. screen 24 in FIG. 1, positioned closely adjacent to (beneath) top screen element 14. The openings in screens 14 and 24 could be configured relative to each other such that the combined openings for the two screens is dependent upon the positional relationship between the two screens. Sliding movement of one screen, i.e. screen 24, will change the size of the combined opening. Other means for conveniently varying the size of the openings will be obvious to one skilled in the art. It should also be understood that the variable hole size structure could be used only for a portion of the top screen 14, such as the first section alone of a three section screen. The remainder of the screen will then have fixed hole sizes.

The variable hole size feature for the top screen 14 can be used by itself or in combination with the integrated gyratory/thickness screen combination in which the top screen element is shorter than the lower screen element, which in turn extends beneath a portion of the thickness screen. This combination permits a significant capability of optimizing both the amount of mass being conveyed to the thickness screen and the size distribution (on a thickness basis) of the various fractions of wood chips produced by the overall system. The top screen 14 is reduced substantially in size to its most efficient length (very few chips drop through the screen after the first 12 feet), while the fines screen 16 remains 20 feet long, extending under a substantial portion (typically at least one-third) of the disk screen, an arrangement which results in efficient and substantially optimal undersize chip removal.

The resulting overall system can be conveniently optimized, with no additional capital expenditures, to operate at various selected chip thicknesses, for example, 6 mm, 7 mm, 8 mm, 9 mm or 10 mm. This capability thus permits optimization of a chip sizing apparatus to a particular wood, a particular pulping process, and a particular chip size reduction apparatus. In addition, it permits a central screen room system concept in which different wood fiber species are processed using different thickness parameters with relatively minor equipment changes, i.e. automatic top screen hole size changes, resulting in relatively substantial mass flow changes to both the thickness screen 12 and the chip size reduction apparatus, while maintaining acceptable throughput of acceptable size chips.

In operation, an inflow of chips is presented at the inflow end 20 of the gyratory screen apparatus 10. The inflow will move down the inclined, vibrating oscillating top screen 14. A substantial portion of the chips (typically 30–90%) will be within the acceptable size range. A substantial portion of these chips will thus fall through top screen 14 onto the lower screen 16. The material remaining on top of the top screen 14 (15–70%) which moves off the downstream end 22 of the top deck, comprises a first fraction, and includes substantially all of the over-size, over-thick wood chips as well as some chips within the acceptable size range. The first fraction will move to the disk screen 12. In the particular embodiment shown, the top screen is 12 feet long. When the size of the openings in the top screen 14 is controlled to produce mass flow optimization, any additional length of top screen 14 will not produce much, if any, additional acceptable-size chips falling through the top screen.

The top screen 14 is divided in the embodiment shown into three sections, with the openings in the first (max) section 44, the first four feet of the top screen, being variable within the range of 1.25 inches to 1.13 inches. The second (mid) section 46, the second four feet of the top screen, has openings which are variable in the range of 1.13 inches to 1.00 inches. In the third (min) section 48, the last four feet, the openings vary from 1.00 inches to 0.875 inches. The range of variance in each section is thus $\frac{1}{8}$ inch. It should be understood that these ranges can vary somewhat. Also, it should be understood that in some applications only one section, i.e. the max section, will have variable size openings. The other sections will, in such a case, have fixed size openings, albeit perhaps different sizes Typically, the openings are circular in configuration, but they can also have other configurations, such as oval or elliptical, as well.

Again, this capability of varying the size of the openings in top deck 14 provides an opportunity for optimizing the function of the top screen, with respect to the characteristics of the inflow and the desired pulping product. The section approach takes advantage of the relationship which exists between chip length, chip width, screen hole size and specific chip loading rate for the individual specific sections. In addition, the sectional screen, with a variable opening (hole) size capability, has a relatively high overall percent of open area characteristic, considering the maximum and minimum hole sizes available over the three sections. For instance, in the first section, with a hole size range of $1\frac{1}{4}$–$1\frac{1}{8}$ inches, the percent of open area will vary from 56–54%. In the second section, with a hole size range of $1\frac{1}{8}$–1 inch, the percent of open area will be between 54–50%. Lastly, for a third section having a hole size between 1 inch and $\frac{7}{8}$ inches, the percent of open area is 38%. The combined percent of open area is 50.3%. In contrast, a gyratory screen, with a single full-length top screen (i.e. 12 ft.) having openings therein which varied within the specified total range uniformly along the entire length of the top screen, will have a significant loss in net percent of open area when operating near the $\frac{7}{8}$ inch hole size, e.g. approximately 38%.

FIG. 4 shows the optimization capability which exists for obtaining high overthick chip removal efficiency with the present invention by varying hole size against mass loading rate. For example, a hole size of $\frac{7}{8}$ inch and a 0.2 mass loading rate (BDT/Hr/Ft2) will result in an overthick chip removal efficiency of 97%. This same removal efficiency (97%) can also be obtained with a hole size of 1.0 inches and a mass loading rate of 0.6 $BDT/Hr/Ft^2$. Such a result is achieved by a sectionalized top screen.

The material which falls through the top screen 14 and which remains on top of the lower screen 16 is in the acceptable size range and forms the second fraction in the screening process. This material moves off the outflow or downstream end 26 of the lower screen 16 and into the accepts chute. The chips which fall through the top screen element 14 and the lower screen 16 form another sizing fraction (a fifth fraction) and fall into the undersize chip chute 36. Any additional undersize (typically fines) material which is loosened by the action of disk screen 12 will substantially fall onto and through the lower screen 16 into the undersize chip chute.

The first sizing fraction, i.e. the combined over-thick chips along with some accepts, is applied to the thickness screen 12, which as indicated above could be a disk screen or a spiral roll or other thickness screen. In operation, the thickness screen 12 separates the first fraction into third and fourth fractions. The third fraction remains on top of the thickness screen 12 and comprises substantially all the over-thick chips. This material, as discussed above, moves off the downstream end of the thickness screen 12 to the over-thick conveyor and then to a slicer or other size-reduction apparatus. Those chips which fall through the disk screen are within the acceptable size range (along with some fines loosened during the thickness-screening process). These accepts from the thickness screen 12 form the fourth fraction in the sizing process. The fourth fraction (along with the second fraction) fall into the accepts chute and are conveyed to the digester. The third fraction, after processing by the chip-size reduction apparatus, will be directed to the accepts conveyer or back to the inflow end of either gyratory screen apparatus 10 or thickness screen 12.

The system of the present invention thus separates over-thick, accepts and undersize chips in an efficient and economical manner and has the capability of being optimized in operation by changing the size of the openings in the top deck 14, which alters the size/thickness characteristics of the chips ultimately sent to the digester for pulping.

Figure 3:
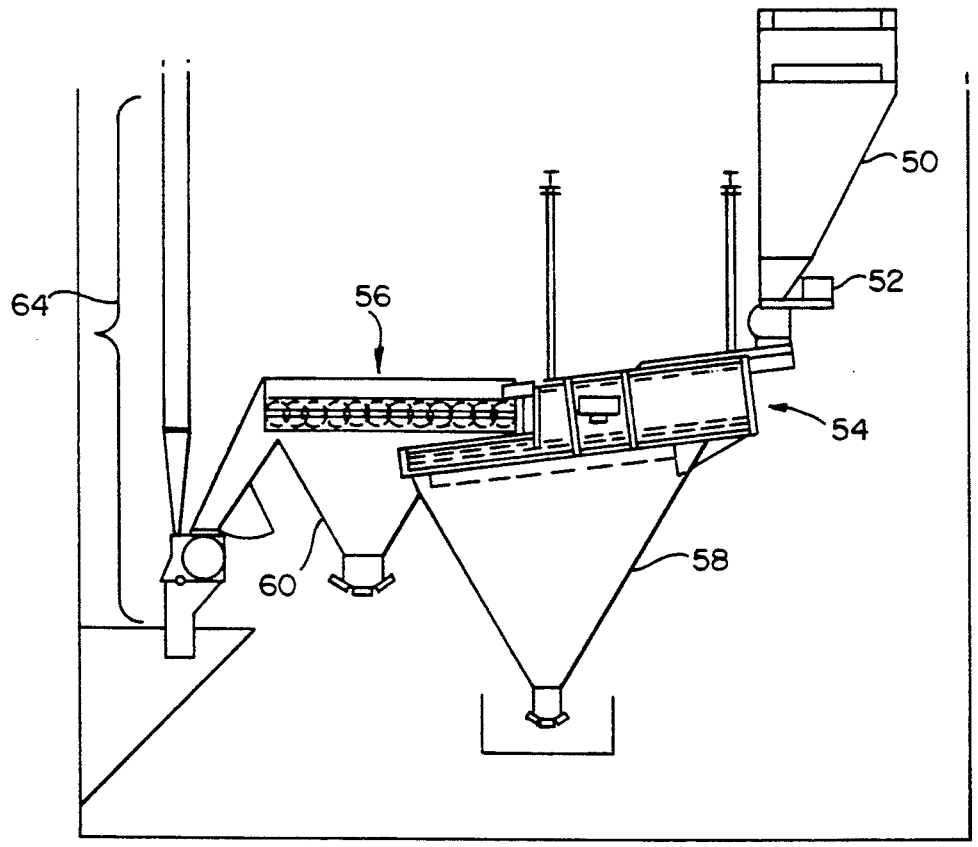
FIG. 3 is a schematic elevational view showing a chip-sizing system, including the integrated chip-sizing screen apparatus of the present invention.

FIG. 3 shows a typical complete chip separation system. A wood chip storage apparatus, such as hopper 50, contains a large amount of wood chips providing the chip inflow through a metering device 52 to the infeed end of a gyratory screen apparatus shown generally at 54. A disk screen 56 extends from the outflow end of the gyratory screen. The gyratory screen 54 and disk screen 56 are arranged in integrated fashion as explained above. Fines fall into chute 58, acceptable-size chips from both the gyratory screen 54 and the disk screen 56 fall into chute 60, while overthick chips are then moved to a contaminant removal system 64, which separates the overthick wood chips from stones and the like. The overthick chips are then sent to a chip slicer which reduces the size of the chips. The resulting reduced size chips may be reprocessed or sent to the digester. The system of FIG. 3 is substantially simpler and less expensive than conventional systems and in addition produces high performance results, as discussed in detail above.

Although a preferred embodiment of the invention has been disclosed for purposes of illustration, it should be understood that various changes, modifications, and substitutions may be incorporated in such embodiment without departing from the spirit of the invention which is defined by the claims which follow:

I claim:

1. An apparatus for sizing an inflow of wood chips, comprising:

a first screening station for producing at least two fractions of wood chips, including a first fraction which comprises substantially all the oversize chips in the inflow together with chips within an acceptable size range, and a second fraction which comprises substantially all remaining chips which are within the acceptable size range; and a second screening station, integrated with the first screening station to the extent that an outflow end of a first portion of the first screening station on which is positioned the first fraction is immediately adjacent to and is functionally integrated with an inflow end of the second screening station, with a second portion of the first screening station, on which is positioned the second fraction, extending underneath the second screening station, the second screening station producing at least two additional fractions of wood chips from the first fraction, including a third fraction, which comprises chips which are substantially all oversize and a fourth fraction, which comprises chips which are substantially all within the acceptable size range.

2. An apparatus of claim 1, wherein the first portion of the first screening station includes a top screen element through which chips which are within the acceptable size range and those chips which are undersize fall and wherein the second portion of the first screening station includes a lower screen element through which only those chips which are substantially undersize fall, defining a fifth fraction, and wherein the outflow end of the top screen element is immediately adjacent the inflow end of the second screening station, the lower screen element being approximately at least 15% longer than the said top screen element and thus extending some distance under the second screening station.

3. An apparatus of claim 2, wherein the top screen element is no longer than necessary to have the second and fifth fractions fall therethrough.

4. An apparatus of claim 3, wherein the top screen element is approximately 12 feet long.

5. An apparatus of claim 2, wherein the lower screen element extends under the second screening station for at least ⅓ of its length.

6. An apparatus of claim 5, wherein the top screen element is approximately 12 feet long and the lower screen element is approximately 20 feet long.

7. An apparatus of claim 1, wherein the first screening station is a gyratory screen and the second screening station is a disk screen.

8. An apparatus of claim 2, wherein the openings in the top screen element are different in size in at least one portion of the longitudinal dimension of the top screen element relative. to the remainder thereof.

9. An apparatus of claim 8, wherein the size of the openings in the top screen element decrease from the inflow end to the outflow end thereof.

10. An apparatus of claim 1, including means for changing the size of the openings in the top screen element.

11. An apparatus of claim 1, including means for sending the third fraction to a size-reduction apparatus.

12. An apparatus for sizing an inflow of wood chips, comprising:

a first screening station for producing at least two fractions of wood chips, including a first fraction which comprises substantially all the oversize chips in the inflow together with chips within an acceptable size range and a second fraction which comprises substantially all remaining chips which are within the acceptable size range, wherein the first screening station includes a top screen element having openings of selected size to permit chips within the acceptable size range to fall therethrough, wherein the openings in the top screening element decrease in size from the inflow end to the outflow end thereof;

means for selectively changing the size of the openings in at least a portion of the top screening element; and a second screening station for receiving the first fraction of wood chips from the first screening station and producing at least two additional fractions of wood chips from the first fraction, including a third fraction which comprises chips which are substantially all oversize and a fourth fraction which comprises chips which are substantially all within the acceptable size range.

13. An apparatus of claim 12, wherein the changing means is operative during operation of the first screening station.

14. An apparatus of claim 12, wherein the apparatus includes means for changing the size of the openings in a plurality of different portions of the top screen element.

15. An apparatus of claim 12, wherein the top screen element is divided into at least three portions longitudinally, the changing means including means for changing the size of the openings in each portion, wherein the range of opening size in each portion is different.

16. An apparatus for sizing an inflow of wood chips, comprising:

a first screening station for producing at least two fractions of wood chips, including a first fraction comprising substantially all oversize chips together with chips within an acceptable size range and a second fraction comprising chips which are substantially all within the acceptable size range, wherein the first screening station includes a top screen element having openings of selected size to permit chips within the acceptable size range to fall therethrough, wherein the size of the openings in the top screen element decrease from the inflow end to the outflow end thereof; and a second screening station for receiving the first fraction of wood chips from the first screening station and producing at least two additional fractions of wood chips, including a third fraction comprising chips which are substantially all oversize and a fourth fraction which comprises chips which are substantially all within the acceptable size range.

17. An apparatus of claim 16, wherein the top screen comprises at least three sections, each section having openings of uniform size but different from each other.

18. An apparatus of claim 16, wherein the openings are within the range of approximately $1\frac{3}{8}$ inches in diameter to $\frac{3}{4}$ inches in diameter.

* * * * *